United States Patent [19]

Hutchings et al.

[11] 4,082,647

[45] Apr. 4, 1978

[54] SIMULTANEOUS AND CONTINUOUS HYDROCRACKING PRODUCTION OF MAXIMUM DISTILLATE AND OPTIMUM LUBE OIL BASE STOCK

[75] Inventors: Le Roi E. Hutchings, Mt. Prospect; Thomas E. Sahlin, Elmhurst, both of Ill.

[73] Assignee: UOP Inc., Des Plaines, Ill.

[21] Appl. No.: 749,138

[22] Filed: Dec. 9, 1976

[51] Int. Cl.[2] ..... C10G 13/04; C10G 37/02; C10G 41/00

[52] U.S. Cl. ..... 208/78; 208/18; 208/59; 208/80; 208/92

[58] Field of Search ..... 208/55, 59, 78, 80, 208/18, 92

[56] References Cited

U.S. PATENT DOCUMENTS

| | | | |
|---|---|---|---|
| 3,159,565 | 12/1964 | Kimberlin et al. | 208/79 |
| 3,243,367 | 3/1966 | Mason et al. | 208/59 |
| 3,267,021 | 8/1966 | Gould | 208/78 |
| 3,331,766 | 7/1967 | Young | 208/78 |
| 3,380,910 | 4/1968 | Griffiths | 208/58 |

*Primary Examiner*—Delbert E. Gantz
*Assistant Examiner*—G. E. Schmitkons
*Attorney, Agent, or Firm*—James R. Hoatson, Jr.; John G. Cutts, Jr.; William H. Page, II

[57] ABSTRACT

A process is provided for the simultaneous and continuous hydrocracking of two feed stocks for production of maximum distillate and optimum lube oil base stock. The second feed is mixed with vaporous phase from separation of effluent from conversion of first feed stock, preferably deasphalted crude resid.

5 Claims, 1 Drawing Figure

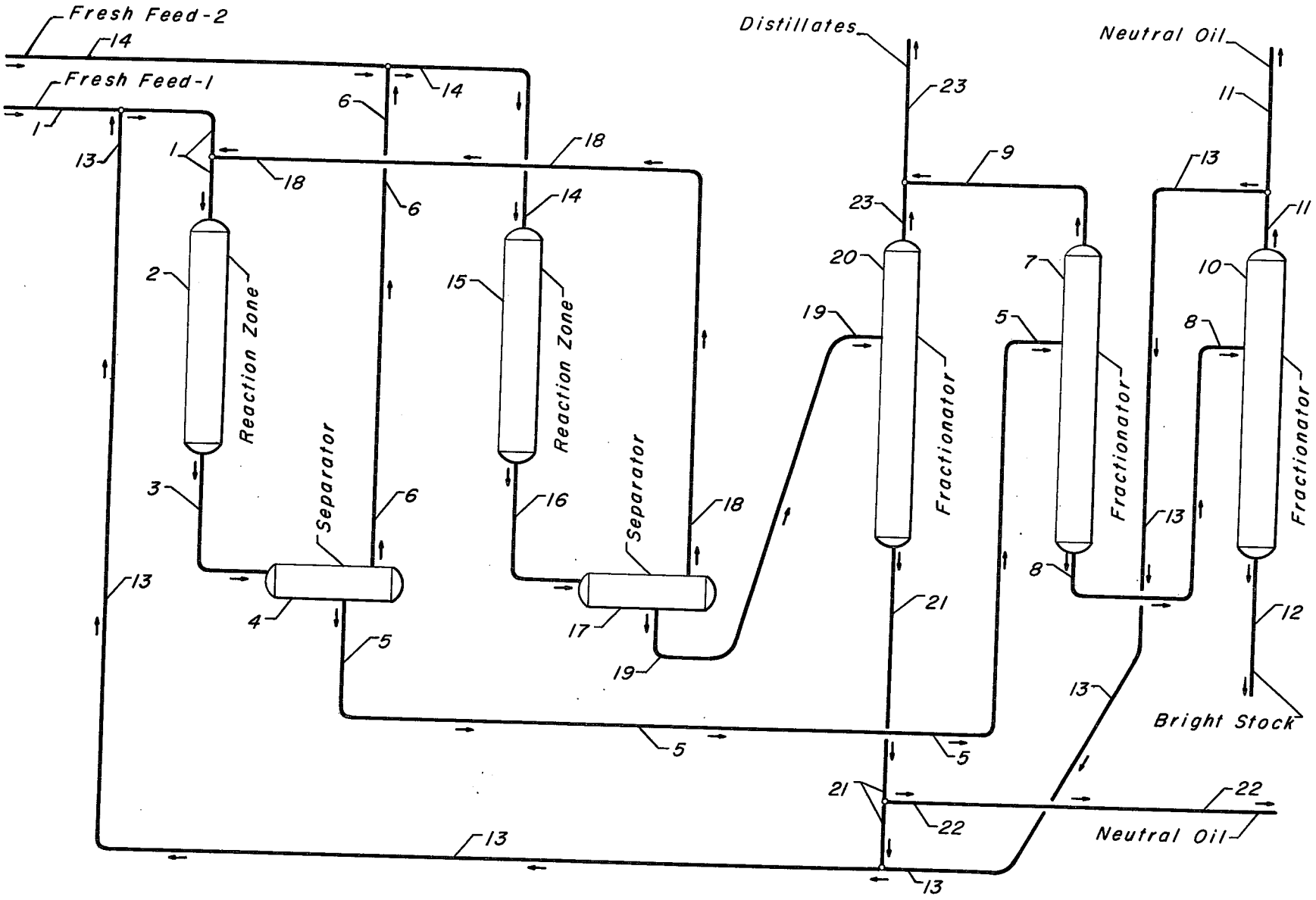
Fractionator
Fractionator
Fractionator
Separator
Separator
Reaction Zone
Reaction Zone
Reaction Zone
Neutral Oil
Bright Stock
Neutral Oil
Distillates
Fresh Feed-2
Fresh Feed-1

SIMULTANEOUS AND CONTINUOUS HYDROCRACKING PRODUCTION OF MAXIMUM DISTILLATE AND OPTIMUM LUBE OIL BASE STOCK

BACKGROUND OF THE INVENTION

The present invention involves the catalytic conversion of hydrocarbons in a multiple-stage process. More particularly, the present invention is directed toward the production of lubricating oil base stocks having viscosity indices above 100. A lubricating oil base stock is synonymously referred to in the art as a "neutral oil," and is, in effect a dewaxed hydrocarbon mixture, boiling in the lubricating oil boiling range, which does not contain viscosity improvers or other additives. That is, a "lubricating oil" denotes in the art a dewaxed product containing various additives. Through the utilization of the present invention, there is produced a waxy lubricating oil base stock having a viscosity index of above about 100. Following dewaxing, a standard prior art technique, the viscosity index remains above 100, and the resulting neutral oil is highly desirable for the production of multi-graded lubricating oils.

The prior art is replete with references to crude oils containing hydrocarbon components suitably adaptable for use as lubricating oils. In general, those lubricating oils derived from highly paraffinic crude stocks are utilized in the production of high quality motor oils, aviation oils and turbine oils. This type of lubricating oil is characterized by a relatively high viscosity index (V.I.), although, it actually is a blend of relatively low and relatively high viscosity index components. Lubricating oil base stocks which are derived from highly naphthenic crudes are employed in the production of lubricating oils having exceptionally desired properties with respect to a heavy duty use such as that found in diesel engines. Desirable components of lubricating oil base stocks, or neutral oils, are iso-paraffins and molecules containing single rings, whether naphthenic or aromatic. However, essentially all heavy hydrocarbonaceous fractions, derived from crude oils, contain condensed-ring as well as straight-chain hydrocarbons. Characteristically, condensed-ring hydrocarbons have low viscosity indices and relatively poor resistance to oxidation. Therefore, they are undesirable as components of the various types of lubricating oils.

A perusal of the prior art procedures and techniques for producing lubricating oil base stocks indicates that relatively high viscosity index lubricating oils may be produced through the use of a combination of solvent extraction techniques and clay-treating, acid-treating, etc. Some heavy duty lubricating oils are obtained by way of vacuum distillation followed by alkali-treating for the removal of naphthenic acids. The complex nature of high viscosity index lubricating oil production presents a challenge to the petroleum industry in the form of significant processing problems which are not easily solved through the use of present-day operating techniques. For example, solvent extraction of the undesirable components is inefficient in view of the fact that the available solvents are not highly selective for the components which must be removed from the lubricating oil base stock. Furthermore, immense, complicated equipment is required for contacting the lubricating oil with the solvent and for the recovery of the solvent in order to make the process economically attractive. With respect to acid-treating and clay-treating techniques, problems involve disposal of clay and loss of hydrocarbon yield, as well as an acidic sludge disposal problem when strong acids, such as sulfuric acid, are employed. By way of brief summation, it might be said that the prior art schemes are severely hampered in their capability to produce pure lubricating oils having high viscosity indices, and are tedious and expensive to operate in an acceptably efficient manner.

Candor compels recognition of the fact that certain prior art techniques are required if satisfactory lubricating oils are to be produced. Thus, it is necessary to subject a crude oil to one or more distillation techniques in order to provide a crude oil bottoms product concentrated in lubricating oil base stock. Another prior art scheme which may be required as a preliminary processing step, with respect to some crude oil bottom product, is a deasphalting process. The crude oil bottoms, containing asphaltenic constituents, is intimately admixed with a light hydrocarbon solvent such as propane, butane or hexane, at conditions of temperature and pressure under which the asphaltenic constituents are precipitated. In view of the fact that the preliminary processing techniques of distillation and deasphalting are well known to those skilled in the art of petroleum refining technology, and form no essential part of our invention, further description thereof is not believed required herein.

Another prior art technique is necessary in order to produce a suitable lubricating oil base stock. Waxy constituents must be removed to improve the overall quality of the ultimate lubricating oil. The dewaxing technique is accomplished by a well known method which generally employs solvents such as propane, methyl isobutyl ketone, methylethyl ketone, toluene, etc. The waxy lubricating oil base stock and solvent are heated to a temperature sufficiently high to render the solvent and base stock substantially miscible. The resulting mixture is then chilled to precipitate the wax from the solution. As hereinafter indicated, the dewaxing step adversely affects the viscosity index of the dewaxed product. Through the utilization of the present invention, a waxy lubricating oil base stock, having a viscosity index above 100 is produced.

Until now, there has been no facile method for producing superior lubricating lube oil base stocks while at the same time producing maximum non-lube oil distillate. Examples of non-lube oil distillate are LPG, gasoline and kerosene.

OBJECTS AND EMBODIMENTS

A principal object of the present invention resides in the simultaneous and continuous hydrocracking of a hydrocarbon stock to produce maximum distillate and optimum lube oil base stock. A corollary objective is to produce a dewaxed lube oil base stock pool having a flat viscosity index profile. "Viscosity Index Profile" is herein defined as the change in viscosity index as a function of the viscosity of the lube oil cut taken from the entire lubricating oil base stock pool.

Before describing the various embodiments of the present invention, brief reference to the accompanying drawing will be made, in conjunction with the terms employed in the embodiments and appended claims, in order that a clear understanding of the invention is made available. The drawing is a simplified schematic flow diagram of the present invention.

With reference now to the drawing, the first hydrocarbon charge enters the process via line 1.

Therefore, referring briefly to the drawing:

(1) The "first hydrocarbon charge stock" is introduced to via line 1.

(2) The "first hydrocracking reaction zone" is reactor 2.

(3) The "second hydrocarbon charge stock" is introduced via line 14.

(4 ) The "second hydrocracking reaction zone" is reactor 15.

(5) The "first separation zone" is separator 4 which provides a first principally vaporous phase in line 6 and a first principally liquid phase in line 5.

(6) The "second separation zone" is separator 17 which provides a second vaporous phase in line 18 and a second principally liquid phase in line 19.

In achieving the foregoing objects, our invention provides a process for producing hydrocarbon distillates and lubricating oil base stock which comprises the steps of: (a) reacting a first hydrocarbon charge stock and hydrogen in a first hydrocracking reaction zone, at hydrocracking conditions, in contact with a first hydrocracking catalyst; (b) separating the resulting first zone effluent in a first separation zone, to provide a first principally vaporous phase and a first principally liquid phase; (c) reacting said first vaporous phase and a second, lower boiling hydrocarbon charge stock in a second hydrocracking reaction zone, at hydrocracking conditions, and in contact with a second hydrocracking catalyst; (d) separating the resulting second zone effluent in a second separation zone, to provide a second principally vaporous phase and a second principally liquid phase; (e) recycling at least a portion of said first principally liquid phase and at least a portion of said second principally liquid phase to said first hydrocracking reaction zone; (f) separating at least a portion of said first and second liquid phases to recover said hydrocarbon distillates and lubricating oil base stocks.

Other objects and embodiments of our invention involve particularly preferred operating conditions and techniques, as well as preferred catalytic composites for utilization in the hydrocracking reaction zones. These, as well as objects and embodiments of our invention, will become evident from the following more detailed summary of the present process.

The hydrocarbon charge stocks, suitable for use in the present process, are conventional and well known in petroleum refining technology. Thus, suitable charge stocks include vacuum gas oils, propane deasphalted oils, reduced crude stocks, and mixtures thereof. One illustrative feedstock is a mixture of 44.5 volume percent of a raw waxy neutral oil, 23.6 volume percent heavy vacuum gas oil and 31.9 volume percent deasphalted oil. This particular charge stock indicates a gravity of about 24° API, and an initial boiling point of 640° F., a 50% volumetric distillation temperature of about 899° F. and an end boiling point of 1106° F. This feedstock is contaminated with undesirable materials as indicated by the presence of about 0.42% by weight of sulfur and 1300 ppm by weight of nitrogen. Another typical charge stock is a topped vacuum gas oil, derived from an Illinois crude, having a gravity of 22.3° API, an initial boiling point of about 750° F., a 50% volumetric distillation temperature of 905° F. and an end boiling point of about 1050° F. The vacuum gas oil contains about 1630 ppm by weight of nitrogen and 0.44% by weight of sulfur.

The multiple-stage process of the present invention is a catalytic process wherein the catalytic composites are disposed as fixed-beds in the various hydrocracking reaction zones. Although the precise composition of the catalyst need not necessarily be identical in all stages, the catalytically active components of the various composites are generally selected from the metals of Groups VI-B and VIII of the Periodic Table. These metallic components are composited with a porous carrier material, and, in many applications, the catalytic composites will also contain a halogen component, generally from the group of chlorine, fluorine and mixtures thereof. Of necessity, the porous carrier material is refractory with respect to the operating conditions employed in the hydrocracking reaction zones, and it is intended to include those carrier materials which have traditionally been utilized to effect the hydrocracking of hydrocarbonaceous material. In particular, suitable carrier materials are selected from the group of amorphous refractory inorganic oxides including alumina, silica, titania, zirconia, magnesia, alumina-silica, silica-magnesia, alumina-silica-boron phosphate, silica-zirconia, etc. In a case of the amorphous type, one preferred carrier material constitues a composite of alumina and silica, the silica being present in an amount of about 10.0 to about 90.0% by weight. The carrier material may consist of a crystalline aluminosilicate, and may be naturally-ocurring or synthetically-prepared, including mordenite, faujasite, Type A or Type B molecular sieves, etc. When utilized as the carrier, the zeolitic material may be in the hydrogen form or in a form which results from treatment with multivalent cations. No particular refractory inorganic oxide carrier material is essential to the present invention, and it is intended to include within the scope of the present invention all conventional carrier materials, as well as the wide variety of methods for the preparation thereof.

Preferred catalytic composites contain at least one metallic component from the metals of Groups VI-B and VIII as indicated in the Periodic Table of the Elements, E. H. Sargent and Company, 1964, although it is understood that the equivalent results are not achieved through the indiscriminant selection of metallic components. That is to say, a mixture of chromium and cobalt components will not yield results which are equivalent to those obtained through the use of molybdenum and nickel components. Suitable metallic components include chromium, molybdenum, tungsten, iron, nickel and cobalt, as well as the noble metals of Group VIII, ruthenium, rhodium, palladium, osmium, iridium and platinum. The Group VIII noble metal components generally comprise about 0.01% to about 2.0% by weight of the final composite, calculated on an elemental basis. The noble metal components may be incorporated within the catalytic composites in any suitable manner including co-precipitation or co-gellation, ion-exchange or impregnation. When utilized as a component of the catalytic composite, the metals of Group VI-B, chromium, molybdenum and tungsten are utilized in an amount of from about 4.0% to about 30.0% by weight. The iron group metal components, iron, cobalt and nickel will be employed in an amount within the range of about 1.0% to about 10.0% by weight. These metallic components may also be composited with the carrier material in any suitable manner described within the prior art.

The hydrocracking process of the present invention eliminates the necessity for an initial extraction operation; however, as hereinbefore set forth, a final dewaxing technique is practiced in order to prepare a suitable lubricating oil base stock. While solvent extraction removes those components having a low viscosity index without chemical reactions being effected, hydrocracking simultaneously converts the components of low viscosity index into high quality naphthas and distillates, while converting the components of high viscosity index to a lesser extent, whereby the same continue to be within the boiling range of lubricating oils.

In a single-stage unit, the operating conditions necessarily imposed upon the charge stock, in order to improve the viscosity index of the lube oil fraction, are such that excessive cracking of the lower-boiling portion is experienced. Although a single stage unit will produce a lubricating oil base stock having an improved viscosity index, the volumetric yield thereof based upon the fresh feed charge stock is significantly decreased. The present scheme offers a modified series flow wherein the heavy cylinder stock fraction is processed separately from the lighter waxy distillate fraction. In the absence of the lighter material, the heavier charge stock can be processed at a higher severity with the result that a lesser quantity of lubricating oil components are converted into lower-boiling products such as naphtha and kerosene fractions, and the desired high viscosity base stocks are produced from the heavier material. A series of separation techniques are utilized to concentrate and recover a high viscosity index bright stock separate from the waxy lubricating oil base stock product of the process. This permits back-blending of the bright stock with various neutral oils derived from the waxy lubricating oil base stock in order to produce intermediate V.I. lubricating oils. In order to achieve a desired product balance, at least a portion of each reactor effluent is recycled to the first hydrocracking zone.

The hydrocarbon charge stock and hydrogen are contacted with a catalyst of the type hereinabove described in a hydrocracking reaction zone. The particular catalyst selected is primarily dependent upon the characteristics of the charge stock, as well as the desired end result. Although the catalytic composite may be the same in both hydrocracking reaction zones, many situations arise where enhanced results are achieved through the use of different catalytic composites. The contacting may be accomplished by using the catalyst in fixed-bed systems, moving-bed systems, fluidized-bed systems, or in batch-type operations. However, in view of the risk of attrition loss of the catalyst, it is preferred to use a fixed-bed system. Furthermore, it is well known that a fixed-bed catalytic system offers many operational advantages. In such a system, the reactants may be contacted with the catalyst in either upward, downward or radial flow fashion with a downward flow being preferred. Additionally, the reactants may be in the liquid phase, a mixed liquid-vapor phase or a vapor phase when they contact the catalyst.

The catalysts employed in any hydrocracking reaction zone may be employed in one or more reactors within said zone and the feedstocks which are charged to any hydrocracking reaction zone may be introduced to one or more reactors within said zone.

The specific operating conditions imposed upon the individual hydrocracking reaction zones are primarily dependent upon the physical and chemical characteristics of the fresh feed charge stock. However, with respect to the first hydrocracking reaction zone, wherein the heavier deresined oil is processed, the operating conditions will include a pressure from about 1500 to about 3000 psig, an LHSV (liquid hourly space velocity) of about 0.3 to about 3.0 and a hydrogen concentration in the range of about 3000 to about 1500 scf./bbl. In view of the fact that the hydrocracking process is exothermic in nature, an increasing temperature gradient will be experienced as the hydrogen and feedstock traverse the catalyst bed. It is preferred that the maximum catalyst bed temperature in the first hydrocracking reaction zone, be maintained in the range of about 700° to about 900° F. The second hydrocracking reaction zone is maintained at a lower operating severity than that which is imposed upon the first hydrocracking reaction zone. Its lower severity operation is achieved either by decreasing the maximum catalyst bed temperature, or increasing the liquid hourly space velocity, or through a combination of changes in both operating variables. Thus, although the hydrogen concentration and reaction zone pressure may be substantially the same, the maximum catalyst bed temperature will be in the lower range of about 600° to about 860° F., while the liquid hourly space velocity is in the range of about 0.5 to about 4.0. In order to assure that the catalyst bed temperature does not exceed the maximum allowed, conventional quench streams, either normally liquid or normally gaseous and introduced at one or more intermediate loci of the catalyst bed, may be utilized.

In further describing the process encompassed by our inventive concept, reference will be made to the accompanying drawing which illustrates one embodiment. For the purpose of demonstrating the illustrated embodiment, the drawing will be described in connection with a commercially-scaled unit having feed charge rate of about 10,000 barrels per day. It is understood that the charge stock, stream compositions, operating conditions, vessel designs, separators, catalysts and the like, are exemplary only, and may be varied widely without departure from our invention, the scope and spirit of which is defined by the appended claims.

DESCRIPTION OF DRAWING

In the drawing, the embodiment is illustrated by means of a simplified flow diagram in which such details as pumps, instrumentation and controls, heat exchange and heat-recovery circuits, start-up lines, compressor, valving and similar hardware have been omitted as not being essential to an understanding of the techniques involved. The utilization of such miscellaneous appurtenances, to modify the process, is well within the purview of one skilled in the art of petroleum refining techniques.

The fresh feed charge stocks are a waxy distillate and deasphalted oil derived from a full boiling range crude stock. The waxy distillate constitutes about 28.3 vol. percent of the crude, while the deasphalted oil constitutes about 16 vol. percent of the crude. These charge stocks have the characteristics indicated in the following Table 1:

TABLE I

CHARGE STOCK PROPERTIES

| | Waxy Distillate | Deasphalted Oil |
|---|---|---|
| Gravity ° API | 24.0 | 18.8 |
| Distillaton, ° F.: | | |
| Initial boiling point | 563 | 809 |
| 5.00% | 662 | 885 |
| 10.% | 729 | 930 |
| 30.0% | 795 | 1001 |
| 50.0% | 833 | 1059 |
| 70.0% | 862 | 1120 |
| 90.0% | 930 | |
| 95.0% | 955 | |

TABLE I-continued

| CHARGE STOCK PROPERTIES | Waxy Distillate | Deasphalted Oil |
|---|---|---|
| End boiling point | 986 | |
| Sulfur, wt., percent | 2.0 | 2.94 |
| Nitrogen, ppm | 900 | 3,430 |
| Viscosity index | 73 | 81 |
| Wax content, wt. % | 9.0 | 10.6 |

The intended object is to simultaneously and continuously hydrocrack to yield maximum distillate and optimum lube oil base stock.

The deasphalted oil, in an amount of 3000 barrels per day enters the process via line 1 being admixed with a hydrogen-rich recycle vaporous phase transported via line 18 and a hereinafter described recycle stream carried via line 13. Following suitable heat-exchange of the resulting mixture to increase the temperature to about 750° F. at a pressure of about 2500 psig, the heated mixture passes through line 1 into reaction zone 2. The liquid hourly space velocity through the catalytic composite disposed in reaction zone 2 is about 0.5. Reaction zone 2 has disposed therein a fixed-bed of a catalytic composite of 1.8 weight percent nickel and 16 weight percent molybdenum, combined with an amorphous carrier material of 63 weight percent alumina and 37 weight percent silica.

The reactor effluent in line 3 is introduced into separator 4. A principally liquid phase is removed from separator 4 via line 5 and is introduced thereby into fractionator 7. The vaporous phase from separator 4 is introduced into a second hydrocracking reaction zone 15 via lines 6 and 14. The waxy distillate, in an amount of 7000 barrels per day is introduced via line 14 to combine with the first vaporous phase in line 6. The resulting mixture continuing through line 14 into hydrocracking reaction zone 15. Reaction zone 15 is maintained under a pressure of about 2250 psig. and a catalyst bed inlet temperature of about 700° F. with the liquid hourly space velocity being about 1.0. The catalytic composite, disposed in reaction zone 15 is substantially identical to the nickel-molybdenum catalyst disposed within reaction zone 2. The reaction product effluent is withdrawn via line 16 and is introduced therethrough into separator 17. A hydrogen-rich recycle vaporous phase is removed from separator 17 via line 18 and admixed with the feed to reaction zone 2. A principally liquid phase is removed from separator 17 via line 19 and is introduced thereby into fractionator 20. Fractionator 20 is maintained under conditions of temperature and pressure such that a suitable neutral oil is removed via line 21 and at least a portion thereof is recycled via lines 21, 13 and 1 to reaction zone 2. The resulting net neutral oil is removed via line 22. Distillates boiling above the neutral oil boiling range are removed from fractionator 20 via line 23. Hereinabove mentioned fractionator 7 is operated at conditions to separate the distillate boiling below the neutral oil and bright stock boiling range via line 9 and line 23. A liquid stream comprising a mixture of neutral oil and bright stock boiling range oil is removed from fractionator 7 via line 8 and introduced into fractionator 10. Fractionator 10 is operated at conditions which may include a pressure less than atmospheric to separate a neutral oil boiling range stock which is removed via line 11. At least a portion of said neutral oil is passed via line 13 and recycled to reaction zone 2 is hereinabove described. A bright stock boiling range oil is removed from fractionator 10 via line 12.

Pertinent product properties of the bright stock and lubricating oil base stock are presented in the following Table II:

TABLE II

| PRODUCT PROPERTIES | Bright Stock | Neutral Lube Stock |
|---|---|---|
| Gravity, ° API | 30.8 | 31.6 |
| Distillation, ° F.: | | |
| Initial boiling point | 670 | 625 |
| 5% | 742 | 660 |
| 10% | 775 | 680 |
| 30% | 874 | 720 |
| 50% | 955 | 775 |
| 70% | 1018 | 845 |
| 90% | 1112 | 880 |
| 95% | | 900 |
| End boiling point | | 920 |
| Viscosity index | 126 | 120 |
| Viscosity index (dewaxed) | 102 | 103 |

In addition to the properties presented in the foregoing Table II, sulfur and nitrogen analyses on both the bright stock and lubricating oil base stock indicate "nil," or that the two products are substantially completely free from both nitrogenous and sulfurous compounds.

While producing superior lubricating oil base stocks, up to about 80 volume percent of the feedstock is converted to non-lube oil distillate.

The foregoing specification, and particularly the illustration directed to a commercially-scaled unit, indicates the method by which the present invention is effected and the benefits to be afforded through the utilization thereof.

We claim as our invention:

1. A process for producing hydrocarbon distillates and lubricating oil base stock which comprises the steps of:

(a) subjecting a first hydrocarbon charge stock and hydrogen to hydrocracking in a first hydrocracking reaction zone, at hydrocracking conditions, in contact with a first hydrocracking catalyst containing at least one metallic component selected from Groups VIB and VIII of the Periodic Table;

(b) separating the resulting first zone effluent in a first separation zone, to provide a first principally vaporous phase and a first principally liquid phase consisting essentially of hydrocarbon distillate and lubricating oil;

(c) subjecting said first vaporous phase and a second, lower boiling hydrocarbon charge stock in a second hydrocracking reaction zone to hydrocrack said lower boiling hydrocarbon to a distillate possessing a lesser boiling point than said lower boiling hydrocarbon in contact with a second hydrocracking catalyst containing at least one metallic component selected from Groups VIB and VIII of the Periodic Table at hydrocracking conditions;

(d) separating the resulting second zone effluent in a second separation zone, to provide a second principally vaporous phase and a second principally liquid phase consisting essentially of hydrocarbon distillates and lubricating oil;

(e) separating said first liquid phase in a second fractionation zone to recover said distillate as the overhead effluent and said lubricating oil as the bottoms effluent; and (f) separating said second liquid phase in a first fractionation zone to recover said distillate as the overhead effluent and said lubricating oil as the bottoms effluent.

2. The process of claim 1 further characterized in that said hydrocarbon charge stock has an initial boiling point in the range of about 800° to about 925° F.

3. The process of claim 1 further characterized in that said second hydrocarbon charge stock has an initial boiling point above 600° F.

4. The process of claim 1 further characterized in that the hydrocracking conditions, imposed upon said first hydrocracking reaction zone, include a maximum catalyst bed temperature of from about 700° to about 900° F. and a liquid hourly space velocity of from 0.3 to about 3.

5. The process of claim 1 further characterized in that the hydrocracking conditions imposed upon said second hydrocracking reaction zone include a higher liquid hourly space velocity in the range of about 0.5 to about 4, a lower maximum catalyst temperature of from about 600° to about 860° F., or a higher liquid hourly space velocity and a lower maximum catalyst bed temperature.

* * * * *